United States Patent [19]

Becker et al.

[11] Patent Number: 4,828,579

[45] Date of Patent: May 9, 1989

[54] THERMALLY INSULATED QUENCH RING FOR A GASIFIER

[76] Inventors: Michael W. Becker, 16221 Keats Cir., Westminster, Calif. 92683; Allen M. Robin; John S. Stevenson, both of P.O. Box 400, Montebello, Calif. 90640

[21] Appl. No.: 164,750

[22] Filed: Mar. 7, 1988

[51] Int. Cl.[4] ..... C10J 3/48

[52] U.S. Cl. ..... 48/69; 48/DIG. 2; 55/240; 55/256

[58] Field of Search ..... 48/192 R, 206, 76, 69, 48/63, 64, 77, DIG. 2; 55/256, 240; 422/207

[56] References Cited

U.S. PATENT DOCUMENTS

| | | | |
|---|---|---|---|
| 4,192,654 | 3/1980 | Brooks | 48/DIG. 2 |
| 4,444,726 | 4/1984 | Crothy et al. | 48/69 |
| 4,653,677 | 3/1987 | Peters et al. | 48/DIG. 2 |

*Primary Examiner*—Peter Kratz

*Attorney, Agent, or Firm*—Robert A. Kulason; James J. O'Loughlin; Robert B. Burns

[57] ABSTRACT

Reactor for gasifying a carbonaceous fuel to produce a usable gas, and comprising an insulated outer shell. A reaction chamber within the shell receives a fuel mixture from an injection burner. The products or effluent of gasification include hot produced gases which are passed through a constricted throat to be cooled in a liquid bath. A dip tube, which guides the hot effluent into the bath, is provided with a stream of coolant from a quench ring. The latter is supported below the reaction chamber and is provided with a thermal barrier along its surface that is exposed to the hot produced gas. The barrier will reduce thermal stress in the quench ring and reduce drain of heat from the gasifier throat, thus avoiding premature chilling of the slag component.

7 Claims, 2 Drawing Sheets

THERMALLY INSULATED QUENCH RING FOR A GASIFIER

BACKGROUND OF THE INVENTION

In the production of a usable synthesis gas by the combustion of a carbonaceous fuel mixture, the process is conducted most effectively under a high temperature and high pressure conditions. For example, for the production of a gas from a carbonaceous fuel such as particulated coal, coke or even oil, a preferred operating temperature range of about 2,000° to 3,000° F. is maintained at a pressure of between about 5 to 250 atmospheres. The harsh operating conditions experienced in such a process, and in partcular the wide temperature variations encountered, will impose a severe strain on many segments of the gasifier or reactor units.

The invention is addressed to an improvement in the structure of the gasifier, and particularly in the quench ring and the dip tube arrangement. The latter., by their functions, are exposed to the gasifier's maximum temperature conditions by virtue of the hot product gas which makes contact with these members as they pass from the reaction chamber.

U.S. Pat. No. 4,218,423 issued on Aug. 19, 1980 in the name of Robin et al, illustrates one form of quench ring and dip tube which can be improved through use of the present arrangement. U.S. Pat. No. 4,444,726 issued on Apr. 24, 1984 in the name of Crotty et al, also illustrates a dip tube and quench ring for a reactor vessel. In the latter, a portion of the gasifier's cooling system is insulated, but does not provide an effective barrier which would avoid contact between the hot effluent stream and the cold quench ring surface.

Among the problems encountered due to the high temperature conditions within the gasifier, is the developing of thermal stresses which often result in damage to the quench ring as a result of the ring's close proximity to the hot effluent stream. These problems are often manifested in the form of cracks and fissures which develop in parts of the quench ring. The latter usually in areas particularly where sharp corners are present such that any physical or thermal stress would be magnified and result in leakage of liquid coolant into the reactor chamber.

A further operational difficulty can be experienced in gasifiers as a result of the propensity of molten slag to harden and freeze in the gasifier's constricted throat. This phenomena results when the throat section becomes sufficiently cool to reduce the slag temperature as the latter flows out of the reaction chamber.

This undesirable chilling action can under particular circumstances, severely block the constricted throat opening, thereby precluding further operations.

BRIEF DESCRIPTION OF THE INVENTION

Toward overcoming the stated operating defects in gasifiers of the type contemplated, there is presently disclosed a gasifier quench ring which is provided with a refractory face alongits exposed surfaces. It is thereby insulated to minimize thermal stresses which would be normally encountered during a gasification process. The refractory is positioned by a support element or shelf which extends from the quench ring.

Stated otherwise, there is presently provided a reactor for gasifying a carbonaceous fuel mixture to produce a hot effluent comprising residual slag and a useful synthesis gas. The reactor includes a reaction chamber in which the fuel mixture is gasified, the floor of said chamber being shaped to permit liquefied slag to flow therefrom.

A quench chamber holding a water bath is positioned in the reactor to receive and cool hot produced effluent. A constricted throat communicating the reaction chamber with the quench chamber directs a stream of the effluent through a dip tube which defines a guide passage to conduct said effluent into the water bath.

A toroidal shaped quench ring depending from the gasifier floor is spaced outwardly of the dip tube to direct a water stream onto the dip tube,s guide surface. A support element depending from the quench ring extends into the effluent guide passage, and supports a refractory belt which defines a thermal barrier between the quench ring and the guide passage.

It is therefore an object of the invention to provide an improved gasifier for producing a usable gas, in which a gasifier dip tube is wetted by a quench ring which embodies a thermal barrier to segregate it from the hot effluent as well as from hot segments of the gasifier.

A further object is to provide a liquid carrying quench ring for a gasifier, which is separated from hot effluent produced by the gasifier combustion chamber by means of a thermal resistant refractory barrier carried on the quench ring exposed surfaces.

A. still further object is to provide a gasifier quench ring having a refractory layer positioned to form a portion of the guide passage which conducts hot effluent gas between the gasifier's constricted throat and the water bath thereof.

Figure 1:
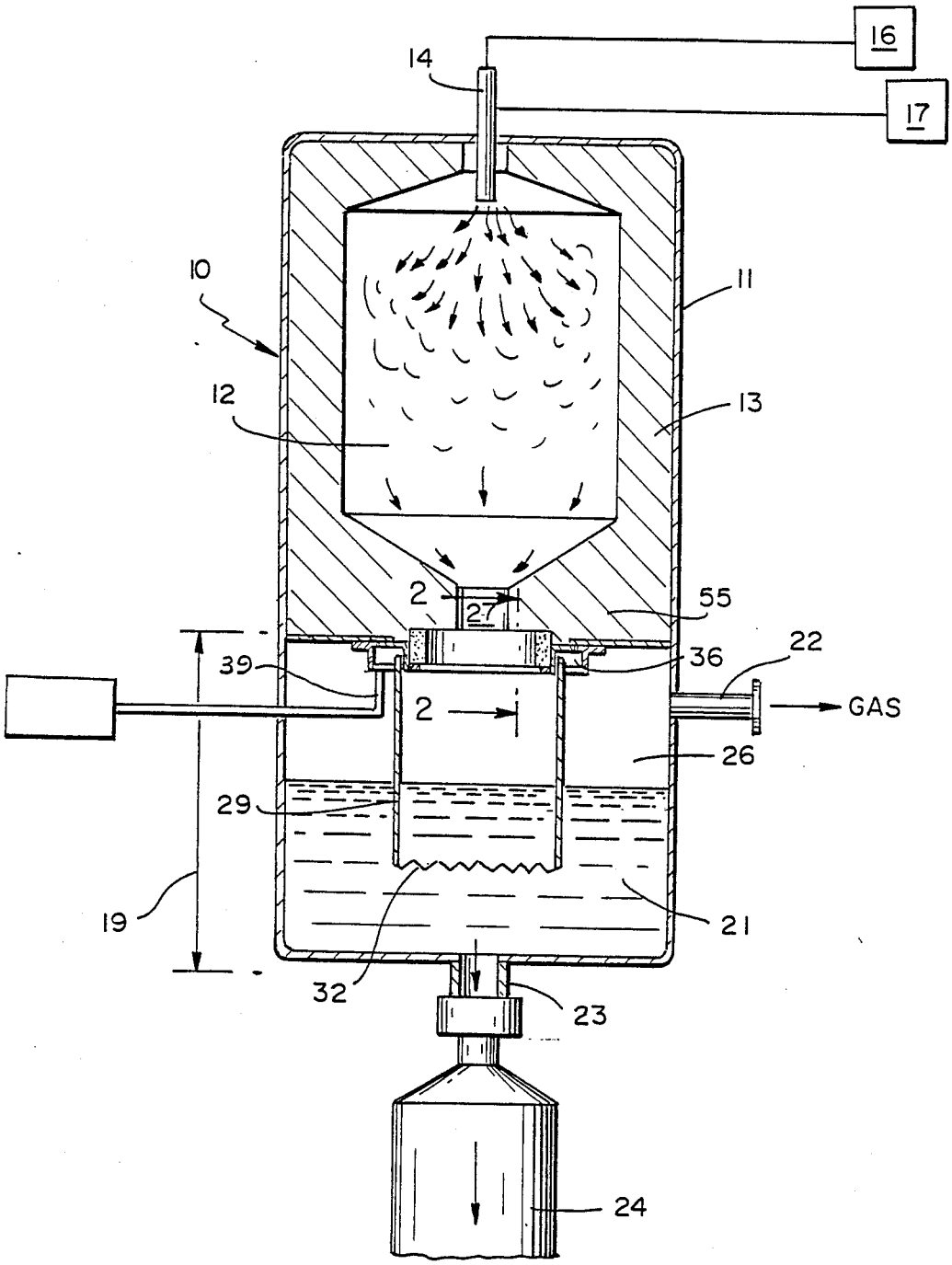
FIG. 1 is a vertical elevation view in cross-section of the gasifier or reactor of the type contemplated.

Briefly, in achieving the stated objectives, and referring to FIG. 1, there is provided a gasifier or reactor vessel for gasifying a carbonaceous fuel mixture either solid, liquid or gaseous. The process produces a hot effluent which includes a useful synthesis gas, and a residue normally in the form of particulated ash, when the fuel is solid such as coal or coke. The gasifier is embodied in a heavy walled steel shell which is positioned to form a downflowing stream of the effluent which includes the hot produced synthesis gas.

A reaction chamber within the shell receives a pressurized stream of the fuel mixture by way of the fuel injection burner. The latter is communicated with a source of the carbonaceous fuel a well as with a source of a gasification supporting gas such as oxygen or air whereby to form a combustible mixture.

The products of gasification, or the hot effluent which is generated in the reaction chamber, is discharged through the reaction chamber floor to be cooled in a liquid holding quench chamber.

To facilitate passage of hot produced gas as it leaves the reaction chamber, a dip tube is positioned to guide the effluent into a liquid bath. The dip tube, oriented in the generally upright position, is supported by a liquid conducting quench ring which directs a stream of coolant such as water along the dip tube's exposed guide face or inner wall.

Referring to FIG. 1, a gasifier or reactor vessel 10 of the type contemplated embodies an elongated metallic steel walled shell 11. The shell is normally operated in an upright position to permit a downflowing of the produced product. Shell 11 includes a reaction chamber 12 at the upper end to withstand the high operating temperatures between 2,000° to 3,000° F. Chamber 12 is provided with a lined inner wall 13, preferably formed of a suitable refractory material.

Burner 14 is removably positioned at shell 11 upper wall to inject the carbonaceous fuel mixture such as particulated coal or coke from source 16, into reaction chamber 12. An amount of a gasification supporting gas from a pressurized source 17 is concurrently fed into burner 14 as a part of the fuel mixture.

The invention can be applied equally as well to gasifiers which burn a variety of carbonaceous solid liquid, or gaseous fuels. To illustrate the instant embodiment, it will be assumed that burner I4 is communicated with. a source 16 of coke. The latter is preferably preground and formed into a slurry of desired consistency by the addition of a sufficient amount of water. The pressurized gas at source 17 is normally oxygen, air, or a mixture thereof.

The lower end of reaction chamber 12 is defined by a downwardly sloping refractory floor 33. This configuration enhances the discharge of hot gas and liquefied slag from the reaction chamber 12.

The lower end of shell 11 encompasses a quench chamber 19 into which the products of gasification are directed. Here, both solid and gaseous products contact liquid coolant bath 21 which, is most conveniently comprised of water. The cooled gas then emerges from quench bath 21 into disengaging zone 26 before leaving the quench chamber through line 22. The cooled gas is now processed in downstream equipment and operations into a usable form. The sold or slag component of the effluent sinks through bath 21 to be removed by way of discharge port 23 into lockhopper 24.

Reaction chamer 12 and quench chamber 19 are communicated through constricted throat 27 formed in the reaction chamber floor 33. To achieve efficient contact of the hot effluent as it leaves reaction chamber 12 with the liquid in bath 21, quench chamber 19 as noted is provided with a dip tube 29 having an upper edge 31 positioned adjacent to constricted throat 27. Dip tube 29 further includes a lower edge 32 which terminates in the coolant bath 21.

Figure 2:
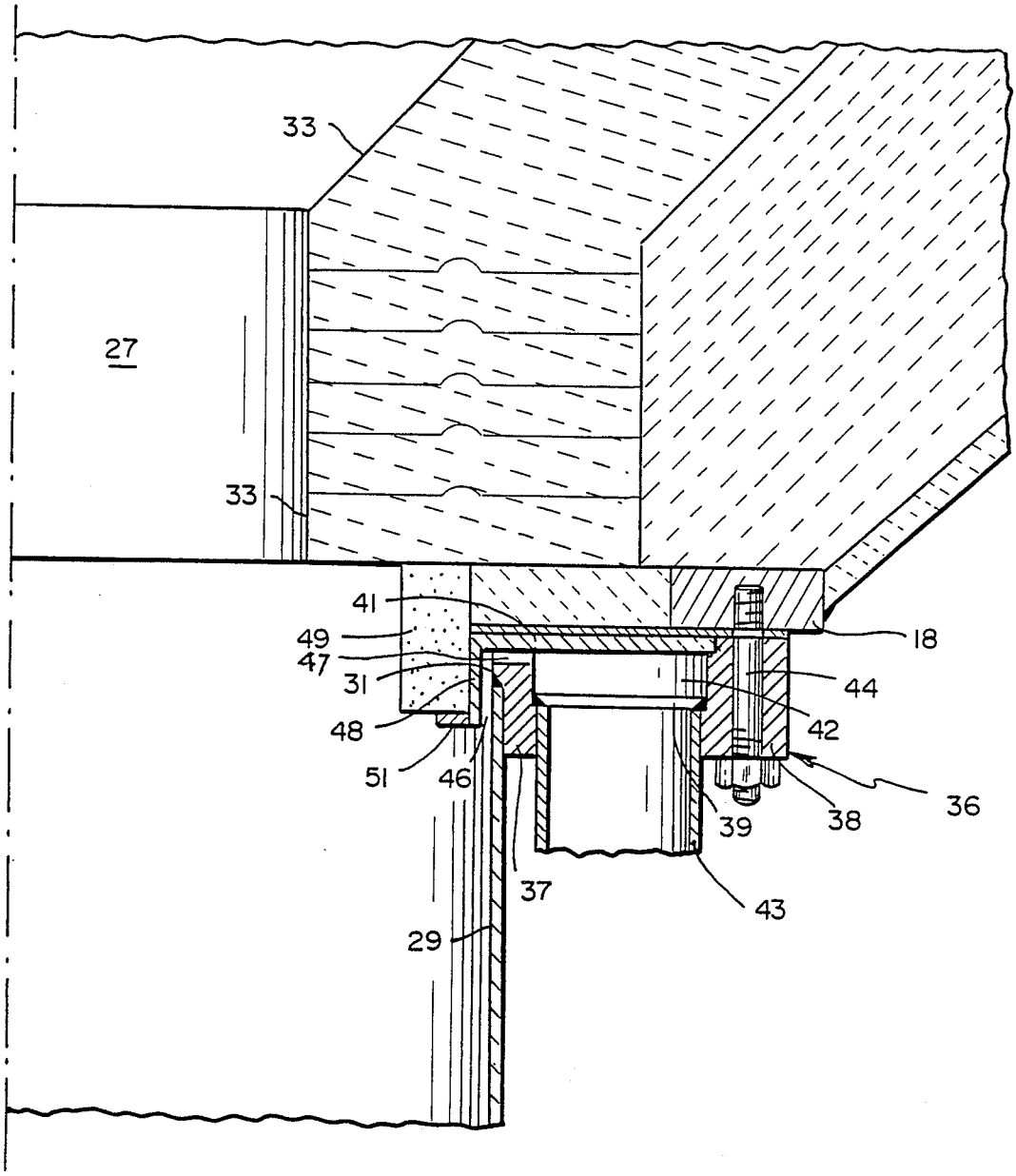
FIG. 2 is a segmentary enlarged view, taken along line 2—2 of FIG. 1.

Referring to FIG. 2, constricted throat 27 defines the initial guide passage through which the high temperature, high pressure effluent passes. Although cooling of the slag is desirable in quench chamber 19, premature cooling in, and immediately beneath throat 27, will prompt the formation of a solid accumulation or barrier. It is desirable therefore to minimize the loss of heat from throat 27 into coolant carrying quench ring 36.

Functionally, the inner wall of dip tube 29 defines a cylindrical guide path for the hot effluent including both the gaseous and solid components as they flow from throat 27 and into water bath 21.

Beneficially, the inner wall or guide surface of the cylindrical dip tube 29 is wetted by directing one or more pressurized streams of water thereagainst.

In one embodiment or configuration, quench ring 36 is comprised of spaced apart inner wall 37 and outer wall 38. Base plate 39 and upper plate 41 define annular toroidal manifold passage or chamber 42 which is communicated with a pressurized source of water by way of one or more risers 43.

Quench ring 36 is removably fastened in place beneath the floor of combustion chamber 12 by a plurality of fastening bolts 44 in outer wall 38.

Upper plate 41 is provided with a downwardly extending rim 48. The latter is spaced from the dip tube 29 upper edge 31 to define an annular vent passage 46. The manifold inner wall 37 is provided with a series of radial passages 47 which direct water from manifold passage 42 into vent passage 46. The latter will in turn direct a continuous liquid coolant stream against the inner surface of dip tube 29 to facilitate passage of the slag carrying effluent into water bath 21 without damage to the dip tube.

Since rim 48 constitutes a cooled surface, it would normally be a sink for conducting heat away from the reaction chamber floor 33 and constricted throat 27. To stabilize this source of undesirable heat flow, rim 48 is provided with a heat insulating layer in the form of a refractory belt 49 which defines a thermal barrier to segregate the cooled quench ring surfaces from the hot effluent flow and the hot floor 33.

Quench ring 36 is therefore provided with means to support the refractory belt without interfering with the effluent flow. In one embodiment, and as shown in FIG. 2, the belt 49 support means takes the form of an annular shelf 51 which depends inwardly from the lower edge of rim 48.

Shelf 51 is positioned at a suitable elevation with respect to the cold inner wall of quench tube 36 to direct the hot effluent flow against the dip tube 29 inner wall. Preferably, rim 48 is sufficiently wide to define a continuous under support surface for a segment of the lower edge of refractory belt 49. However, the latter can be supported alternatively by a series of discrete support brackets or elements which extend inwardly toward the effluent flow and depend from quench ring 36.

The thermally separatingbarrier or belt 49 can be comprised of a series of individual members which are shaped along one side to closely conform with the contour of quench chamber rim 48. Said members are fabricated of a suitable refractory and can be adapted at the respective end faces or junctures to form the desired continuous belt. Preferably, the thermal belt upper edge is placed in abutment with the underside of the reaction chamber floor 33 to preclude leakage between these adjacent surfaces.

Alternately, the thermal barrir 49 can be comprised of a unitary body formed of a castable refractory. In such an instance, the refractory is shaped and positioned in its desired location and thereafter cured or heated to assume a fixed position in relationship to the support element 48.

As shown, the exposed inner face of thermal barrier 49 which faces the hot effluent flow, constitutes a substantially vertical wall. It can, however, be contoured or shaped to best accommodate the hot effluent flow such as by defining an outwardly divergent section thus permitting the hot effluent gases to expand as they emerge from throat 27 and flow toward the water bath 21.

It is understood that although modifications and variations of the invention can be made without departing from the spirit and scope thereof, only such limitations should be imposed as are indicated in the appended claims.

We claim:

1. In a reactor for gasifying a carbonaceous fuel mixture to produce a hot effluent comprising a residual slag and useful synthesis gas, said reactor including:

a shell, means forming a reaction chamber in said shell in which the carbonaeous fuel mixture is gasified, and a refractory floor beneath said means forming a reaction chamber, a quench chamber in said shell holding a water bath in which said effluent is cooled, means forming a constricted throat in said refractory floor communicating the reaction chamber with said quench chamber, and a downwardly extending dip tube positioned in said shell which defines an effluent guide passage to conduct hot effluent into the water bath, a quench ring depending from said refractory floor spaced outwardly of the dip tube, being communicated with a pressurized source of water and having discharge port means opening adjacent to said dip tube to wet said effluent guide passage, a support element depending from said quench ring and extending into the effluent guide passage, and a refractory belt removably positioned on said support element defining a thermal barrier interposed between substantially all of the quench ring surfaces facing hot effluent flow through said effluent guide passage.

2. In the apparatus as defined in claim 1, wherein said refractory belt includes:

a plurality of circularly arranged refractory blocks.

3. In the apparatus as defined in claim 1, wherein said refractory belt is formed of a castable refractory material 4. In the apparatus as defined in claim 1, wherein said refractory belt includes:

a substantially vertical face which forms a segment of said effluent guide passage.

5. In the apparatus as defined in claim 1, wherein said refractory belt includes:

an exposed face which defines an outwardly divergent segment of the effluent guide passage.

6. In the apparatus as defined in claim 1 wherein said support element comprises:

continuous annular shelf which extends into said effluent guide passage.

7. In the apparatus as defined in claim 1, wherein said support element is comprised of:

a plurality of discrete, circularly arranged support members.

* * * * *